United States Patent [19]

Zentgraf et al.

[11] Patent Number: 5,027,766

[45] Date of Patent: Jul. 2, 1991

[54] LOAD ADJUSTMENT DEVICE

[75] Inventors: Matthias Zentgraf, Frankfurt; Gerd Hickmann, Schwalbach, both of Fed. Rep. of Germany

[73] Assignee: VDO Adolf Schindling AG, Frankfurt am Main, Fed. Rep. of Germany

[21] Appl. No.: 531,015

[22] Filed: May 31, 1990

[30] Foreign Application Priority Data

Jun. 10, 1989 [DE] Fed. Rep. of Germany ..... 3919093

[51] Int. Cl.[5] ..... F02D 11/10; F02D 9/00

[52] U.S. Cl. ..... 123/361; 123/399

[58] Field of Search ..... 123/336, 337, 340, 361, 123/399, 494

[56] References Cited

U.S. PATENT DOCUMENTS

| | | | |
|---|---|---|---|
| 4,765,933 | 8/1988 | Nagashima | 261/44.6 |
| 4,785,781 | 11/1988 | Pfalzgraf | 123/396 |
| 4,827,884 | 5/1989 | Cook | 123/361 X |
| 4,848,297 | 7/1989 | Hickmann et al. | 123/361 X |
| 4,850,322 | 7/1989 | Uthoff et al. | 123/399 |
| 4,896,640 | 1/1990 | Pfalzgraf et al. | 123/361 X |

FOREIGN PATENT DOCUMENTS 337099 10/1989 European Pat. Off. .

*Primary Examiner*—Tony M. Argenbright
*Attorney, Agent, or Firm*—Martin A. Farber

[57] ABSTRACT

A load adjustment device is provided having a throttle valve which determines the output of an internal combustion engine and is connected, fixed for rotation, to a throttle-valve shaft (32) which is mounted in a throttle-valve-shaft housing (30). The shaft has an acceleration-pedal side mechanical articulation side (33) and a setting-motor articulation side (34) with which there is associated a coupling element (45) for the mechanical uncoupling of the throttle-valve shaft from the setting motor within a defined angular region of the throttle valve; furthermore, a device is provided for reporting the instantaneous position of the coupling element to an electronic control device. In order, in the case of such a two-sided control of the throttle valve, to permit a structurally simple report of the position of the electric setting motor to the accelerator-pedal-side articulation side, the throttle-valve shaft is developed as a tube and the reporting device has a pass-through shaft (48) which passes through the throttle-valve shaft, a first transmission member (49) which is connected, fixed for rotation, with the pass-through shaft and the coupling element on the setting-motor articulation side and, on the accelerator-pedal-side articulation side, a second transfer member (50) which is connected, fixed for rotation, with the pass-through shaft and which cooperates with an actual-value detection device (18) associated with the control device.

8 Claims, 4 Drawing Sheets

LOAD ADJUSTMENT DEVICE

FIELD AND BACKGROUND OF THE INVENTION

The present invention relates to a load adjustment device having a throttle value which determines the output of an internal combustion engine and is connected, fixed for rotation, with a throttle-valve shaft. The throttle shaft is mounted in a throttle-valve-shaft housing and has a mechanical articulation side on the accelerator pedal side and a setting-motor articulation side. The shaft is associated with a coupling element for a mechanical uncoupling of the throttle-valve shaft from a setting motor in a well-defined angular region of the throttle valve, there being a device for reporting the instantaneous position of the coupling element to an electronic control device.

In such a load adjustment device the throttle valve is customarily controlled on the accelerator-pedal side via a driver which is connected to the articulation side of the throttle-valve shaft and is connected to the accelerator pedal by means, for instance, of a Bowden cable. Under certain conditions of travel, for instance upon adjustment of the speed limitation and/or the idling speed, however, the control of the throttle-valve shaft is effected by an electric setting motor which is associated with the load adjustment device, the control thus preceding the manual adjustment by the driver. From this there results the necessity of uncoupling the throttle valve mechanically for certain angular ranges of the electric setting motor. As a result of this uncoupling it is necessary, to maintain quality of control of the load adjustment device, to report the local position of the electrical setting motor. The detection of the position is effected by a reporting means which is associated with a control device. It is desirable, based on the construction and for purposes of standardization, that the part of the report device which electrically detects the position of the setting motor be arranged on the accelerator-pedal-side mechanical articulation side of the load adjustment device.

SUMMARY OF THE INVENTION

It is an object of the present invention to create a load adjustment device in which, in the case of two-sided control of the throttle valve, a structurally simple reporting back of the position of the electrical setting motor to the accelerator-pedal-side articulation side is possible.

According to the invention, the throttle valve shaft (32) is developed as a tube and the reporting means has a pass-through shaft (48) which passes through the throttle-valve shaft (32), a first transmission member (49) which is connected, fixed for rotation, with the pass-through shaft (48) and a coupling element (45) on the setting-motor articulation side (34). Furthermore, on the accelerator-pedal-side articulation side (33), there is a second transmission member (50) which is connected, fixed for rotation, with the pass-through shaft (48) and cooperates with an actual-value detection device (18) which is associated with a control device (17).

In accordance with the invention, the position of the setting motor or of the coupling element is thus transferred mechanically by means of the pass-through shaft to the actual-value detection device. The actual-value detection device (18) can, in this connection, have a potentiometer (53) which is mounted in the throttle-valve housing (30), and a wiper (52) which forms a part of the potentiometer and is connected to the second transmission member (50).

The first and/or the second transmission member (49, 50) is advantageously developed as a lever.

The throttle valve (55) preferably has, in the region of the throttle-valve shaft (32), a semi-circular profile with an inner curvature which corresponds to the outer curvature of the throttle-valve shaft (32).

Fastening elements (57') in the plane of symmetry of the semi-circular profile preferably connect the throttle valve (55) to the throttle-valve shaft (32).

The fastening elements (57, 57') can be developed, for instance, as screws which pass through recesses in the throttle valve and are screwed into threaded holes in the throttle-valve shaft. In addition, it is deemed advantageous if, furthermore, a cover plate (56) is provided which, in its central region, has a semi-circular profile with a curvature corresponding to the outer curvature of the throttle-valve shaft (32), the fastening means (57) on both sides of the throttle-valve shaft (32) connecting the throttle valve (55) and the cover plate (56) to each other. In the case of a connection of the throttle valve in the region of the semi-circular profile directly to the throttle-valve shaft or to the cover plate, it is thus not necessary to bore through the throttle-valve shaft developed as tube, whereby a free passage for the pass-through shaft is assured.

BRIEF DESCRIPTION OF THE DRAWING

With the above and other objects and advantages in view, the present invention will become more clearly understood in connection with the detailed description of preferred embodiments, when considered with the accompanying drawing of which.

DETAILED DESCRIPTION OF THE PREFERRED EMBODIMENT

Figure 1:
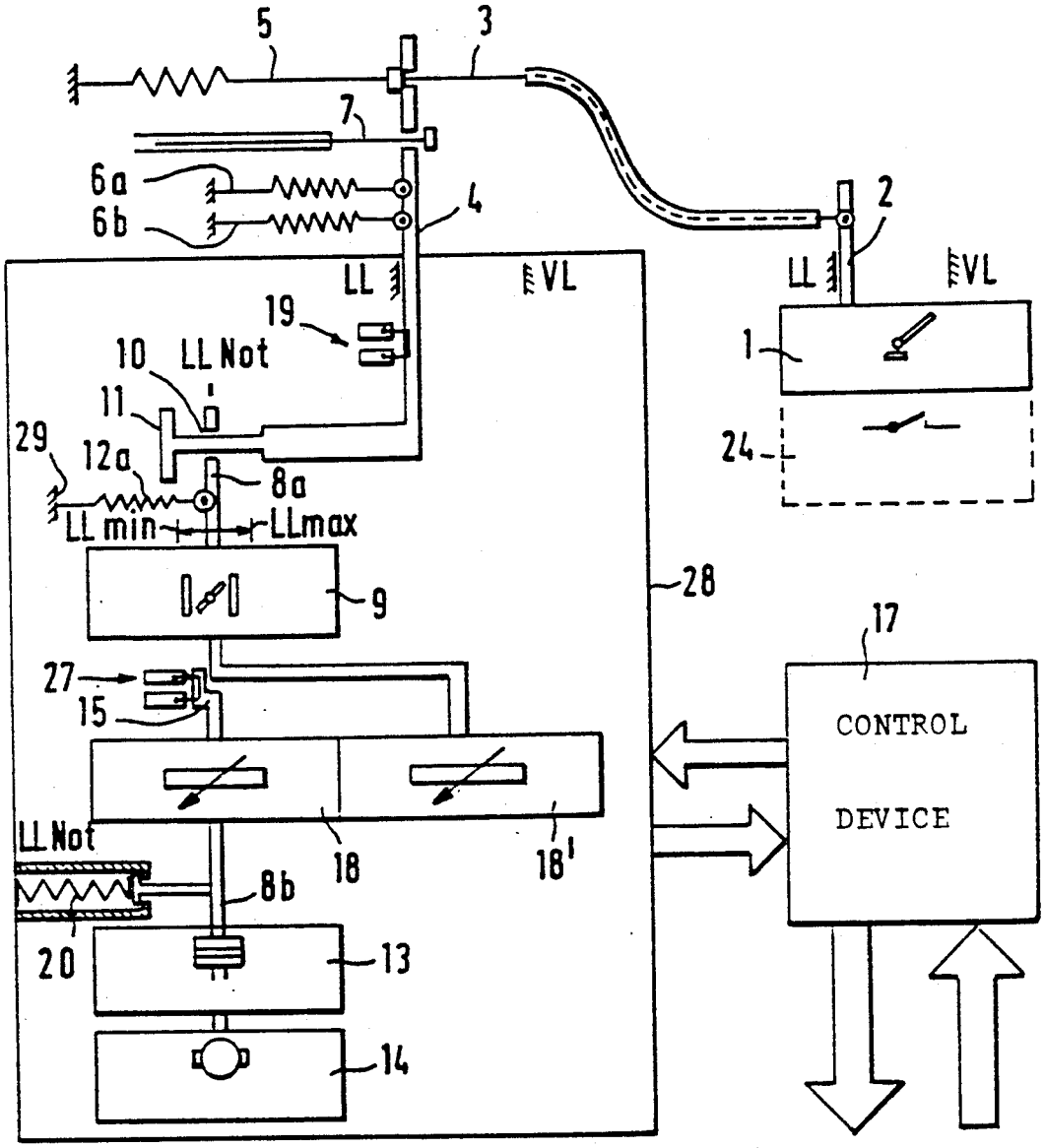
FIG. 1 is a block diagram serving to explain the basic operation of the load adjustment device of the invention.

FIG. 1 shows the basic function of the load adjustment device in the case of a speed-limiting control/idle-control setting member in the function of idle control in the emergency operating position. The figure shows an accelerator pedal 1 by which a lever 2 can be displaced between an idle stop LL and a full load stop VL. The lever 2 can, via a gas cable 3, displace a driver 4 movable between a further idle stop LL and a further full load stop VL in the direction of the full load stop VL associated with it and it is urged in the idle direction by a return spring 5 which acts on the gas cable 3. Two return springs 6a and 6b which act on the driver 4 urge the latter into the idle direction, the springs 6a and 6b being so designed that they have redundant effects on the return drive. When the gas cable 3 is not acted on, the driver 4 thus rests against the idle stop LL associated with it. The driver 4 can also be displaced by means of an automatic pull 7 of an automatic transmission, not shown in detail.

The driver 4 cooperates directly with a first regulating element part 8a which serves for the displacement of the throttle valve 9 of an internal combustion engine. In detail, the end of the first control-element part 8a which faces the driver 4 is provided with a recess 10 behind which an extension 11 of the driver 4 engages. Between the control-element part 8a and a fixed point 29, the load displacement device has a spring 12a which acts in idling direction on the control-element part 8a. By this fixed arrangement of the spring 12a a direct return of the throttle valve 9 is produced, the spring being active over the entire range of adjustment of the control-element part 8a and thus over the entire load range of the internal combustion engine, and the force of the springs 6a and 6b can thereby be reduced. The load adjustment device has, in addition to the first control-element part 8a, a second control-element part 8b which can be connected via a clutch 13 to an electric motor 14.

In order to be able to connect the two control-element parts 8a and 8b mechanically to each other, the second control-element part 8b has an extension 15, the first control-element part 8a extending, on the side of the extension 15 facing the maximum idling position, into the setting path thereof and thus into the setting path of the second control-element part 8b. A movement of the second control-element part 8b in full-load direction thus leads to the application of the projection 15 against the first control-element part 8a which can then be shifted by the electric motor 14 in full-load direction against the force of the spring 12a. The regulating of the load adjustment device is effected by means of an electronic control device 17. With the latter there cooperates an actual-value detection device 18' which is associated with the first control-element part 8a and determines the instantaneous position of said control element part, as well as an actual-value detection device 18 which is associated with the second control-element part 8b and determines the instantaneous position of said control-element part.

In addition, the electronic control device 17 detects signals which come from an idle contact 19 which is always activated when the driver 4 lies against the idle stop LL associated with it. Furthermore, external variables of state with regard to the internal combustion machine or, in general, with respect to the motor vehicle equipped with it are introduced into the control electronics 17 and called up from the latter and transferred by the control electronics to the electric motor 14 which acts on the second control-element part 8b. The electronic control device 17 thus serves, in cooperation with the two actual-value detection devices 18 and 18' and the idle contact 19 as well as the external reference variables, for the purpose of developing a safety logic with respect to the control of the first and second control-element parts 8a and 8b as well as the driver 4.

If the electronic control device 17 or the electric motor 14 is not operating properly, a path-limited spring 20 which is pre-tensioned in the direction toward maximum idling position effects the transfer of the second control-element part 8b into an idle emergency position $LL_{Not}$. In addition to this, the load adjustment device is provided with a contact 27 which detects the entire idling control range of the second control-element part 8b, with a switch point at $LL_{max}$. If a speed-limiting control is to take place in the partial-load/full-load region of the internal combustion engine via the electronic control device 17 and the electric motor 14, then the second control-element part 8b is coupled via the clutch 13 to the electric motor 14, a movement of the second control-element part 8b in the direction towards full load leads first of all to a corresponding movement of the first control-element part 8a up to a position $LL_{max}$; upon further upward control, the contact 27 is switched and thus gives off to the electronic control device 17 a signal that it recognizes in the sense of a speed-limiting control. By the frame 28 it is indicated that the parts surrounded by the frame form a single structural unit. The pedal contact switch is designated 24.

Figure 2:
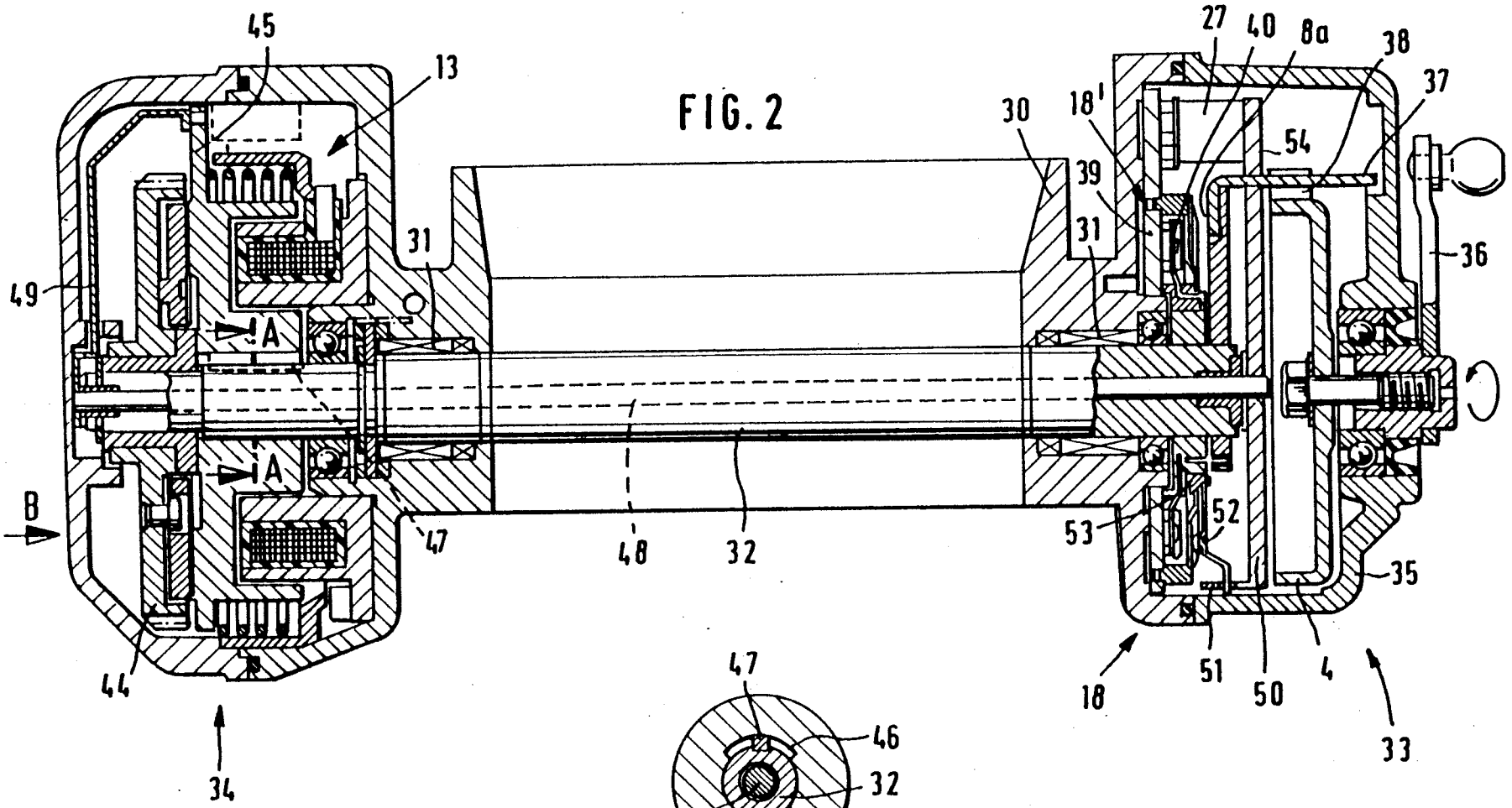
FIG. 2 is a vertical section through the throttle-valve housing in the region of the throttle-valve shaft.
Figure 3:
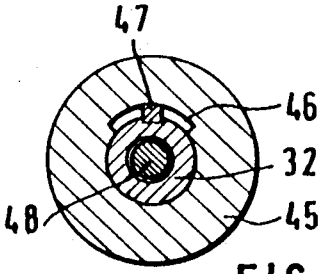
FIG. 3 is a section A—A through the throttle-valve shaft in the region of the coupling element associated with the setting motor.
Figure 4:
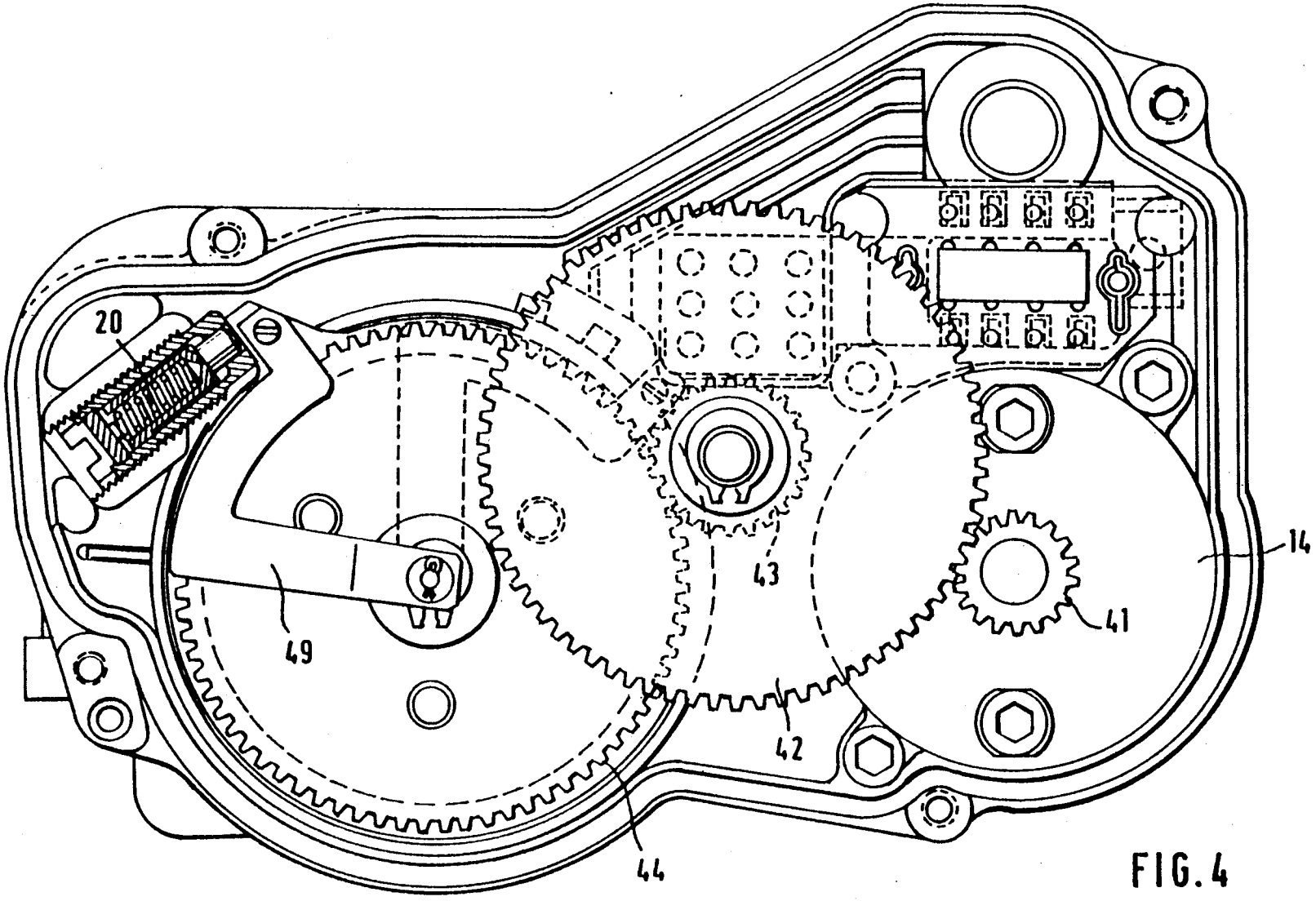
FIG. 4 is a view of the setting-motor articulation side, seen in the direction of the arrow B, with the housing lid removed.

FIGS. 2 to 4 show the structural development of the load adjustment device with the special detection of the position of the electric setting drive by means of the actual-value detection device 18 associated with it. The throttle-valve housing 30 with a throttle-valve shaft 32 developed as tube and mounted in two bearings 31 of the throttle-valve housing 30 is shown. In a manner still to be described, the throttle valve, which is not visible in FIG. 1 since arranged perpendicular to the plane of the drawing, is connected to the throttle-valve shaft in a manner still to be described. The accelerator-pedal-side mechanical articulation side is designated 33, that is the articulation side associated with the driver 4, and the articulation side associated with the setting motor, that is the electric motor 14, is designated 34.

FIG. 2 shows, with respect to the articulation side 33, the swingable mounting of the driver 4 within a housing lid 35 of the throttle-valve housing 30. The driver 4 is fixed for rotation with a lever 36 which, in the broadest sense, forms a part of the driver 4, said lever being adapted to be connected to the gas pull 3. The mounting of the driver 4 is concentric to the mounting of the throttle-valve shaft 32. To the latter there is connected, fixed for rotation, the first control-element part 8a, also developed as a lever, said part extending with an axial extension 37 into the path of movement of the driver 4. In the sense of the free-travel function in the idling range of the driver 4 and first control element part 8a as shown in FIG. 1, the driver 4 has a radial extension 38 which cooperates with the axial extension 37 and permits a well-defined free travel of driver 4 and first control-element part 8a within a small range of angles of rotation. The position of the first control-element part 8a, or of the throttle-valve shaft 32 connected fixed for rotation with it, is detected by the actual-value detection device 18', which consists of a potentiometer 39 inserted in the throttle-valve housing 30 and a wiper 40 which is connected, fixed for rotation, with the throttle-valve shaft 32.

The drive of the throttle-valve shaft 32 over the electric-motor articulation side 34, is effected as can be noted from FIG. 4, via a step-down transmission. There can be noted the electric motor 14 with pinion 41 which meshes with a large intermediate gear 42 and is connected, concentrically to the axis of rotation, in manner fixed for rotation, to a further pinion 43 which meshes with another intermediate gear 44. From FIG. 2 it can be noted that the intermediate gear 44 can be brought, via a coupling element 45 of the clutch 13, into active position with the throttle-valve shaft 32; FIG. 3 furthermore shows the connection of the throttle-valve shaft 32 with the coupling element 45 via a key which passes through an angular recess 46, the angular recess 46 being so dimensioned that a free-travel region of about 80° results between the throttle-valve shaft 32 and the coupling element 45, as a result of which manual control of the throttle valve is not impaired.

It can be noted from FIG. 3 that a pass-through shaft 48 is passed through the tubular throttle-valve shaft 32. The end of this shaft associated with the articulation side 34 is connected, fixed for rotation, with a lever 49 formed of sheet metal which is firmly connected to the coupling element 45 on the outside of the latter. A turning movement of the coupling element 45 thus leads to a corresponding rotation of the pass-through shaft 48. On the articulation side 33, the free end of the pass-through shaft 48 which is associated with it is connected, fixed for rotation, with another lever 50 which is provided with a radial extension 51. To the latter there is connected another wiper 52 which cooperates with another potentiometer 53 which is arranged in the throttle-valve housing 30. Wiper 52 and potentiometer 53 form the actual-value detection device 18 associated with the pass-through shaft 48. The pass-through shaft 48 is furthermore connected, fixed for rotation, with a lever 54 which has the contact 27.

The above remarks show that all structural parts for the direct conversion of mechanical control variables into electrical ones are arranged on the pedal-side mechanical articulation side 33. With respect to the transfer of the movement of the electrical setting drive, this is effected by the special development of the throttle-valve shaft 32 which is developed as a tube and thus permits a transfer of the movement of the electrical setting drive from the articulation side 34 through the throttle-valve shaft 32 to the articulation side 33.

Figure 6B:
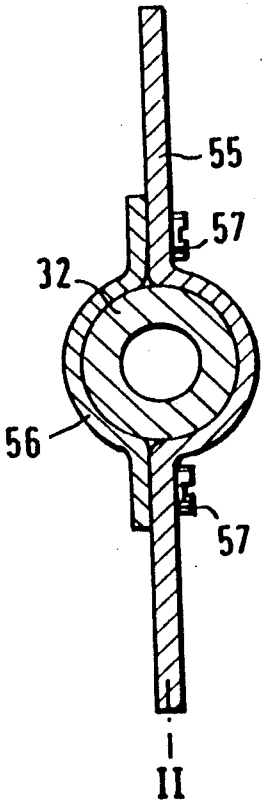
FIGS. 6*a* and 6*b* are a vertical section along the line C—C of FIG. 5 for the two variant attachments.
Figure 6A:
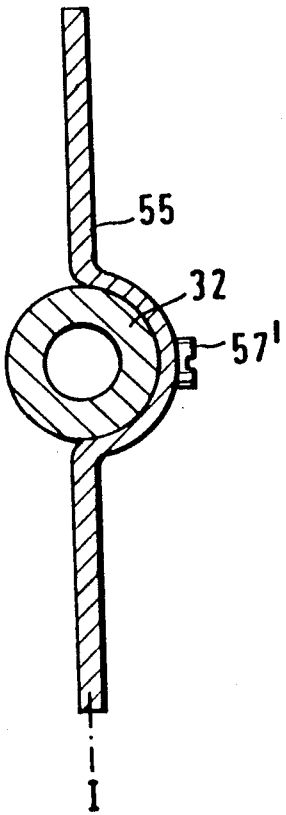
Figure 5:
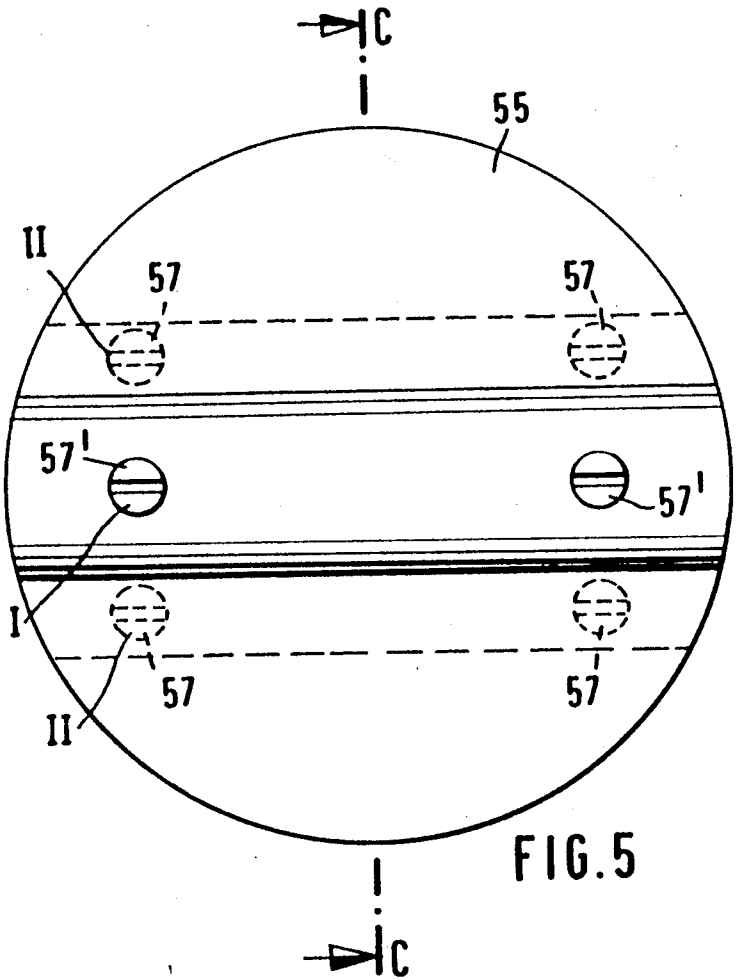
FIG. 5 is a top view of the main surface of the throttle valve as well as of a throttle-valve shaft for two possible variant attachments of throttle valve and throttle-valve shaft.

FIGS. 5, 6*a* and 6*b* show possible manners of attachment of the throttle valve 55 to the throttle-valve shaft 32. In both variants, the throttle valve 55 has, in the region of the throttle-valve shaft 32, a semi-circular profile with its inner curvature corresponding to the outer curvature of the throttle-valve shaft. FIG. 6*b* furthermore shows the attachment of the throttle valve 55 to the throttle-valve shaft 32 by means of an additional cover plate 56 which, in the central region, has a semi-circular profile with an inner curvature corresponding to the outer curvature of the throttle valve 55. In the embodiment of FIG. 6*b* (II), the throttle valve 55 and the cover plate 56 are attached on both sides of the throttle-valve shaft 32 by, in each case, two screws 57 and thus clamp the throttle-valve shaft 32 between them; in the embodiment of FIG. 6*a* (I), the fastening of the throttle valve 55 to the throttle-valve shaft 32 is effected by the direct screwing together of these two parts by means of two screws 57', each of which passes through a bored hole, not shown in detail, in the semi-circular section of the throttle valve 55 and is screwed into a threaded bored hole (also not shown in detail) in the throttle-valve shaft 32.

We claim:

1. A load adjustment device operative with an internal combustion engine and an accelerator pedal, the device comprising a setting motor, and a throttle valve which determines the output of the internal combustion engine;

a throttle-value shaft and a throttle-value shaft housing, said valve being connected, fixed for rotation, with said throttle-value shaft, said shaft being mounted in said housing and having a mechanical articulation side on a side of the accelerator pedal and a setting-motor articulation side;

a coupling element for mechanically uncoupling the throttle-valve shaft from the setting motor in a well-defined angular region of the throttle valve;

an electronic control device, and a reporting device for reporting the instantaneous position of the coupling element to the electronic control device; and wherein the throttle valve shaft is formed as a tube, and the reporting device comprises a pass-through shaft which passes through the throttle-valve shaft;

the load adjustment device further comprises a first transmission member which is connected, fixed for rotation, with the pass-through shaft, the load adjustment device including a second transmission member, and an actual value detection device;

said coupling element is located on the setting-motor articulation side;

on the accelerator-pedal articulation side, the second transmission member is connected, fixed for rotation, with the pass-through shaft and cooperates with the actual-value detection device, the latter being operative with the electronic control device.

2. Load adjustment device according to claim 1, wherein said actual-value detection device has a potentiometer which is mounted in the throttle-valve shaft housing, there being a wiper which forms a part of the potentiometer and is connected to the second transmission member.

3. Load adjustment device according to claim 2, wherein at least one of said first and said second transmission members is formed as a lever.

4. Load adjustment device according to claim 1, wherein at least one of said first and said second transmission members is formed as a lever.

5. Load adjustment device according to claim 4, wherein said throttle valve has, in the region of the throttle-valve shaft, a semi-circular profile with an inner curvature which corresponds to an outer curvature of the throttle-valve shaft.

6. Load adjustment device according to claim 5, further comprising a cover plate which, in its central region, has a semi-circular profile with a curvature corresponding to the outer curvature of the throttle-valve shaft; and fastening means on both sides of the throttle-valve shaft connecting the throttle valve and the cover plate to each other.

7. Load adjustment device according to claim 5, further comprising fastening elements located in the plane of symmetry of the semi-circular profile to connect the throttle valve to the throttle-valve shaft.

8. Load adjustment device according to claim 7, wherein said fastening elements are formed as screws.

* * * * *